US006336020B1

(12) United States Patent
Ishikawa et al.

(10) Patent No.: US 6,336,020 B1
(45) **Date of Patent: *Jan. 1, 2002**

(54) IMAGE FORMING APPARATUS HAVING AN IMPROVED DEVELOPER-SUPPLYING MECHANISM AND METHOD THEREOF

(75) Inventors: Tomoji Ishikawa; Kazuyuki Sugihara, both of Yokohama; Yoshiyuki Kimura, Tokyo; Kenji Maeda, Isehara; Yoshihide Kawamura, Suntou-gun; Fumio Ogata, Fuji, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/576,440

(22) Filed: May 22, 2000

Related U.S. Application Data

(63) Continuation of application No. 09/164,282, filed on Oct. 1, 1998, now Pat. No. 6,104,900.

(30) Foreign Application Priority Data

Oct. 3, 1997 (JP) ..... 9-287976
Feb. 9, 1998 (JP) ..... 10-044701
Sep. 4, 1998 (JP) ..... 10-267486

(51) Int. Cl.[7] ..... G03G 15/01; G03G 15/08
(52) U.S. Cl. ..... 399/227; 399/262; 399/263
(58) Field of Search ..... 355/27; 399/22, 399/30, 224, 227, 258, 262, 230, 263, 113, 111, 112, 119, 223

(56) References Cited

U.S. PATENT DOCUMENTS 4,975,748 A * 12/1990 Koinuma et al. ..... 399/347
5,105,226 A * 4/1992 Sugihara ..... 399/276
5,109,254 A * 4/1992 Oka et al. ..... 399/257
5,296,900 A * 3/1994 Saijo et al. ..... 399/260
5,384,628 A * 1/1995 Takami et al. ..... 399/255
5,416,568 A * 5/1995 Yoshiki et al. ..... 388/285
5,500,719 A * 3/1996 Ishikawa et al. ..... 399/238
5,552,877 A * 9/1996 Ishikawa et al. ..... 399/227
5,565,973 A * 10/1996 Fujishiro et al. ..... 399/227
5,617,198 A * 4/1997 Ishikawa et al. ..... 399/27
5,646,721 A * 7/1997 Sugihara et al. ..... 399/176
5,722,020 A * 2/1998 Matsuoka et al. ..... 399/262
5,752,141 A * 5/1998 Nishimura et al. ..... 399/227
5,758,235 A * 5/1998 Kosuge et al. ..... 399/227
5,761,576 A * 6/1998 Sugihara et al. ..... 399/90
5,765,059 A * 6/1998 Kosuge et al. ..... 399/224
5,768,664 A * 6/1998 Kosuge et al. ..... 399/227
5,787,328 A * 7/1998 Sugihara et al. ..... 399/224
5,850,586 A 12/1998 Sugihara et al. ..... 399/227
5,903,806 A * 5/1999 Matsuoka et al. ..... 399/258
5,915,151 A * 6/1999 Kaneko et al. ..... 399/227
5,918,092 A * 6/1999 Hama ..... 399/227
5,940,664 A 8/1999 Sugihara et al. ..... 399/227
5,956,549 A 9/1999 Sugihara et al. ..... 399/227
5,991,569 A * 11/1999 Sugihara et al. ..... 399/113

(List continued on next page.)

*Primary Examiner*—Russell Adams
*Assistant Examiner*—R. J. Fuller
(74) *Attorney, Agent, or Firm*—Oblon, Spivak, McClelland, Maier & Neustadt, P.C.

(57) ABSTRACT

A developer container for use in an image forming apparatus including a supporting member rotating around a rotation shaft thereof. A plurality of developing devices are arranged on the supporting member, each developing device including a developer supplying device. A plurality of cylindrically-shaped developer containers containing developer are provided, each developer container having an opening and a guide, and each developer container being detachably mounted on the developer supplying device. A container rotating device rotates the developer container, in which the guide is arranged that when one of the developing devices needs to be filled with the developer, the container rotating device rotates the developer container to transfer the developer in the developer container to the opening in accordance with a rotating movement of the developer container.

7 Claims, 14 Drawing Sheets

U.S. PATENT DOCUMENTS 6,072,967 A 6/2000 Sugihara et al. ..... 399/110
6,104,900 A 8/2000 Ishikawa et al. ..... 399/227
6,122,469 A 9/2000 Miura et al. ..... 399/227
6,141,520 A 10/2000 Kosuge ..... 399/262

* cited by examiner

IMAGE FORMING APPARATUS HAVING AN IMPROVED DEVELOPER-SUPPLYING MECHANISM AND METHOD THEREOF

This application is a Continuation of Ser. No. 09/164,282 filed Oct. 1, 1998 now U.S. Pat. No. 6,104,900.

BACKGROUND OF THE INVENTION

1. Field of the Invention

The disclosed mechanism and method relates to an image forming apparatus, and more particularly to an image forming apparatus that includes a rotary image-developing station which is capable of efficiently supplying developers to multiple image-developing units without a time delay.

2. Discussion of the Background

An image forming apparatus that adopts a rotary image developing station using a plurality of color developers (e.g., toner) has been placed on the market. The rotary image-developing station generally includes a plurality of image-developing devices each for developing an image using a developer and a supporting member for supporting the image-developing devices. The supporting member is disposed in front of an image bearing member that bears a latent (to-be-developed) image thereon, and has a rotary axis in parallel to the rotary axis of the image bearing member.

Accordingly, a rotation of the supporting member causes the image-developing devices to revolve around the rotary axis of the supporting member. Each of the image-developing devices includes a developer container that contains a developer to be used for developing the latent image formed on the image bearing member. The revolving movement of the image-developing devices may be controlled to bring each of the image-developing devices individually to a position where an image-developing operation may be performed relative to the latent image formed on the image bearing member.

Many of the above-described rotary image-developing stations employ a developer container that typically has an opening for passing a developer and that rotates together with the image-developing device so that the developer drops around the opening by its own weight inside the developer container. Then, the developer passes to the image-developing device.

In the thus configured rotary image-developing station, a control of supplying developer is crucially important to prevent the image-developing device from containing an excessively large or small amount of developer. This is the case because the supplying amount of the developer to the image developing device from the developer container relies on the rotational movement of the developer container but not on the amount of developer remaining in the image-developing device.

If the image-developing device contains an excessively large or small amount of developer, an image may be developed in an improper image density on the image bearing member.

Therefore, many of the rotary image-developing stations employ a developer supply amount controller at an inside of a casing of the image-developing device to control the supply amount of developer. The developer supply amount controller has a developer inlet which fits to the opening of the developer container to receive a developer from the opening of the developer container. The developer supply amount controller controls the supply amount of the developer to the image-developing device.

Keeping in line with the recent downsizing trend of image forming apparatus, the developer supply amount controller as well as the rotary image-developing station are required to be smaller. Consequently, the opening of the image-developing device and the inlet of the developer supply amount controller are required to be compact in size as well. As a result, the developer container cannot be made in an arbitrary shape but is in a special flat shape in order to discharge all the developer in the developer container, using a drop by its own weight, through the small opening to outside of the developer container.

However, there is a case in which the developer container cannot be made in the above-mentioned preferred special flat shape. For example, the applicants of the present invention have proposed an image forming apparatus which has a retractable rotary image-developing station in Japanese Patent Application No. 9-208705 (1997), improving the maintainability of the individual image-developing device.

In this retractable rotary image-developing station, a toner bottle is used as a developer container and is configured in a cylindrical shape rather than the special flat shape so as to be efficiently accommodated by the supporting member. Also, in this retractable rotary image-developing station, the toner bottle is provided with a developer conveying member (hereinafter referred to as an agitator) which transfers toner inside the toner bottle to completely discharge the toner in the toner bottle through the opening thereof. However, since the toner bottle is consumable and is disposed of when finished, the agitator provided therein is also disposed of together with the developer container. Accordingly, the developer container having an expensive agitator therein results in not only increasing a running cost per copy, but also causing problems in aspects of natural resource conservation and global environmental protection.

Based on the above result, the applicants of the present invention have proposed an improved developer container (e.g. toner bottle) in Japanese Patent Laid-open application No. 9-287976 (1997). Such a developer container is in a cylindrical shape, revolving around the rotation axis of the rotary image-developing station, and is capable of supplying the developer without using the agitator. This developer container includes a special guide formed on an inner wall of the developer container so that the developer is conveyed to the opening along the guide inside the developer container as the rotary image-developing station rotates.

The above-mentioned improved developer container is also capable of conveying the developer in different directions by mounting more than one block of the guide. Furthermore, the guide of the inner wall is made in a form of a spiral projection, so that the manufacturing cost of the developer container is further reduced and, as a result, the running cost per copy is also reduced.

However, the above-mentioned improved developer container has a problem. The problem is that the developer in the improved developer container can be transferred to the image-developing device only when the developer container revolves by the rotation movement of the rotary image-developing station.

Accordingly, when an event that one of the image-developing devices has an excessively decreased amount of developer is detected, the rotary image-developing station is required to rotate so that the developer container moves and the developer in the developer container is transferred to the image-developing device. At this time, the developer in the developer container is conveyed to the inlet of the image-developing device through the opening of the developer container by the rotating movement of the rotary image-developing station, which movement is controlled to continue for a predetermined time period.

That is, in this image forming apparatus, the rotary image-developing station is required to rotate for a certain time period in order to move the developer container to supply the developer into the image-developing device when the image-developing device in operation has a smaller amount of developer relative to a predetermined value. This rotating movement of the rotary image-developing station to supply the developer into the image-developing device interrupts the copying operation. Accordingly, the operator needs to wait until filling of the developer is completed before the copying operation is executed.

As described above, the developer supplying operation from the developer container to the image-developing devices depends on the rotating movement of the developer container in accordance with the rotation of the rotary image-developing station. It is difficult to solve the above-mentioned problem of waiting time by independently moving the developer container at an increased speed. Therefore, it is believed that there is no image forming apparatus which employs a rotary image-developing station capable of supplying developers in a highly sufficient manner without causing a waiting time when supplying the developers.

SUMMARY OF THE INVENTION

In light of the above problems, an object of the present invention is to provide a novel image forming apparatus which includes a rotary image-developing station capable of supplying developers in a highly sufficient manner without causing a waiting time when supplying the developers.

These and other objects are achieved by providing a novel image forming apparatus that includes a supporting member which rotates around a rotation shaft thereof. A plurality of developing devices are arranged in a star-like form on the supporting member, each developing device including a developer supplying device. A plurality of cylindrically-shaped developer containers which contain developer are provided, each developer container having an opening and a guide, and each developer container being detachably mounted on the developer supplying devices. Further, a container rotating device rotates the developer container, in which the guide is arranged that when one of the developing devices needs to be filled with the developer the container rotating device rotates the developer container to transfer the developer in the developer container to the opening in accordance with a rotation movement of the developer container.

A novel developer container is provided for use in an image forming apparatus, which includes a fixed portion which is fixed on a developer supplying device of the image forming apparatus and a rotating portion which is rotatably supported by the fixed portion and includes a guide which is integrally formed with the developer container. The rotating portion is rotated by a container rotating device of the image forming apparatus so that developer contained in the developer container is transferred to an opening of the developer container and flows out to the developer supplying device.

A novel method according to the present invention includes the step of transferring developer from a developer container to a developing device in an image forming apparatus. The method also includes the steps of providing a developing device with a developer supplying device, forming a developer container in a cylindrical shape, forming an opening on the cylindrically shaped developer container, forming an integral developer guide wall inside the developer container, inserting developer into the developer container, detachably mounting the developer container on the developer supplying device, and rotating the developer container.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
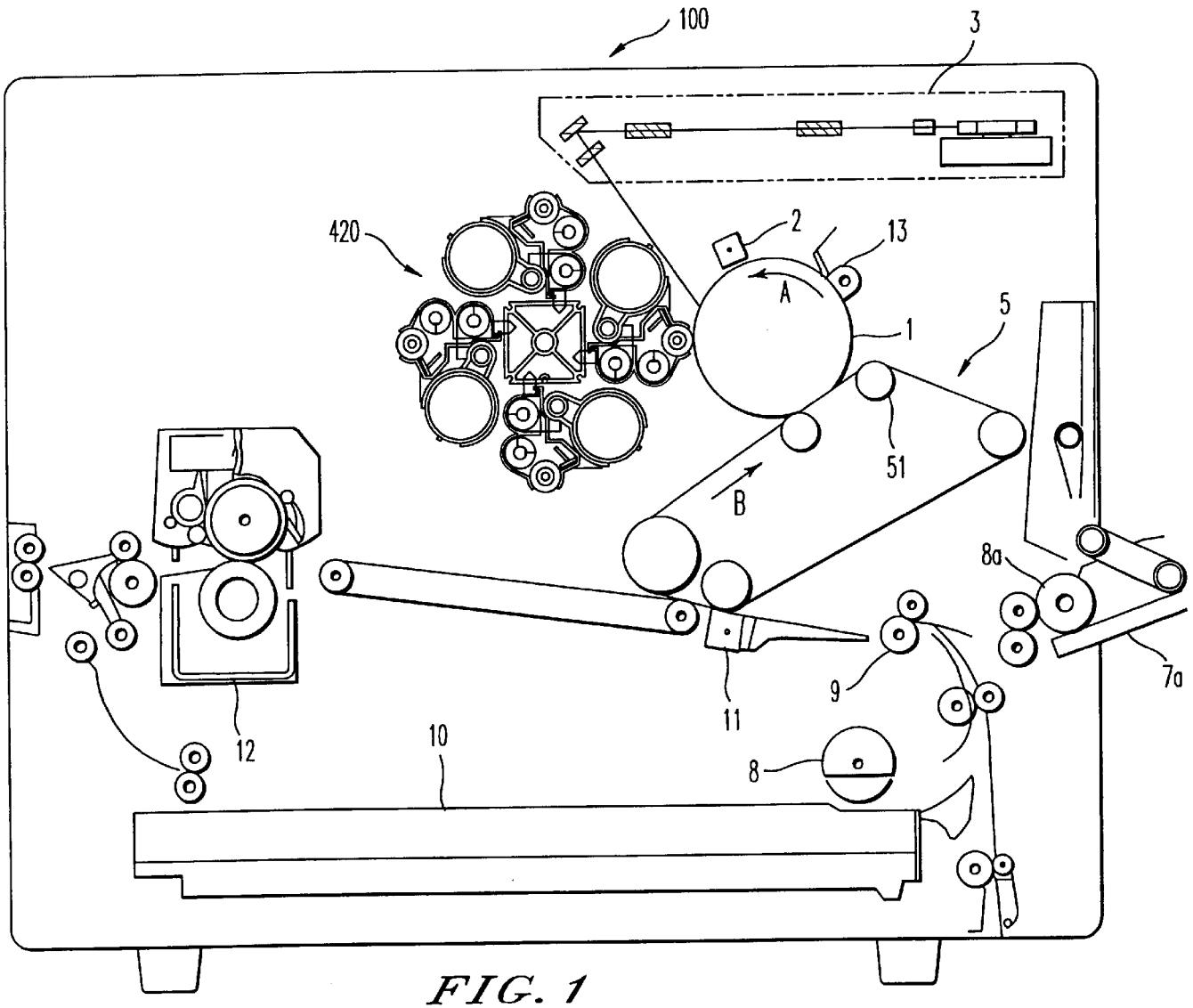
FIG. 1 is a front elevation illustrating a schematic construction of a printer relevant to the present invention.

An embodiment of the present invention is described in detail referring to the figures, wherein like reference numerals indicate identical or corresponding parts throughout the several views.

An embodiment of the present invention applied for a color electrophotographic printer 100 as an image forming apparatus is described hereinbelow.

As illustrated in FIG. 1, the printer 100 includes a photoconductive drum 1 as an image bearing member which is charged by a charger 2 as a uniform charging device and which is rotated in the direction A. Thereafter, a laser optical writing device 3 writes an electrostatic latent image according to image information on the surface of the photoconductive drum 1 through a scanning operation. The image information for exposure is mono-color image information in yellow, magenta, cyan, or black, which is spectrally resolved from a required full color image. The electrostatic latent image formed on the photoconductive drum 1 is developed by a rotary image-developing station 420 using developers, such as yellow, magenta, cyan, or black toner, for example. Thereby, each color image is formed on the photoconductive drum 1.

Each color image formed on the photoconductive drum 1 is transferred to an intermediate transfer belt 5 that rotates in the direction B of FIG. 1. The intermediate transfer belt 5 rotates in synchronism with the photoconductive drum 1 and receives the mono-color images of yellow, magenta, cyan, and black one after another so as to form a multi-layered color image. This transfer operation to the intermediate transfer belt 5 is performed by applying the predetermined bias voltage to a transfer bias roller 51 under a state that the photoconductive drum 1 makes contact with the intermediate transfer belt 5.

The yellow, magenta, cyan, and black images superimposed onto the intermediate transfer belt 5 are transferred onto a transfer sheet 10 that is conveyed to a transfer section from an automatic sheet feeding cassette 7 or a manual sheet feeding tray 7*a* through a sheet feeding roller 8, 8*a,* and a registration roller 9. The automatic sheet feeding cassette 7 is used for either one of a single-face copy or a duplex copy. This transferring operation of the multi-layered color image is performed at one time with a second transfer charger 11. After the transferring section, the toner image is fixed on the transfer sheet 10 by a fixing unit 12, and transfer sheet 10 is then disposed from the main body with a full color print formed thereon.

The toner which remains on the photoconductive drum 1 after the image transferring operation from the drum 1 to the intermediate transfer belt 5 is removed therefrom by a photoconductive element cleaner 13. The toner on the intermediate transfer belt 5 that remains on the intermediate transfer belt 5 after the image transferring operation from the intermediate transfer belt 5 to the transfer sheet is removed from the intermediate transfer belt 5 by an intermediate transfer belt cleaner (not shown).

The rotary image-developing station 420 has an opening which faces the photoconductive drum 1, and also has four image-developing devices 420K, 420Y, 420M, and 420C having an approximately similar configuration and positioned along a circumferential direction.

Figure 2:
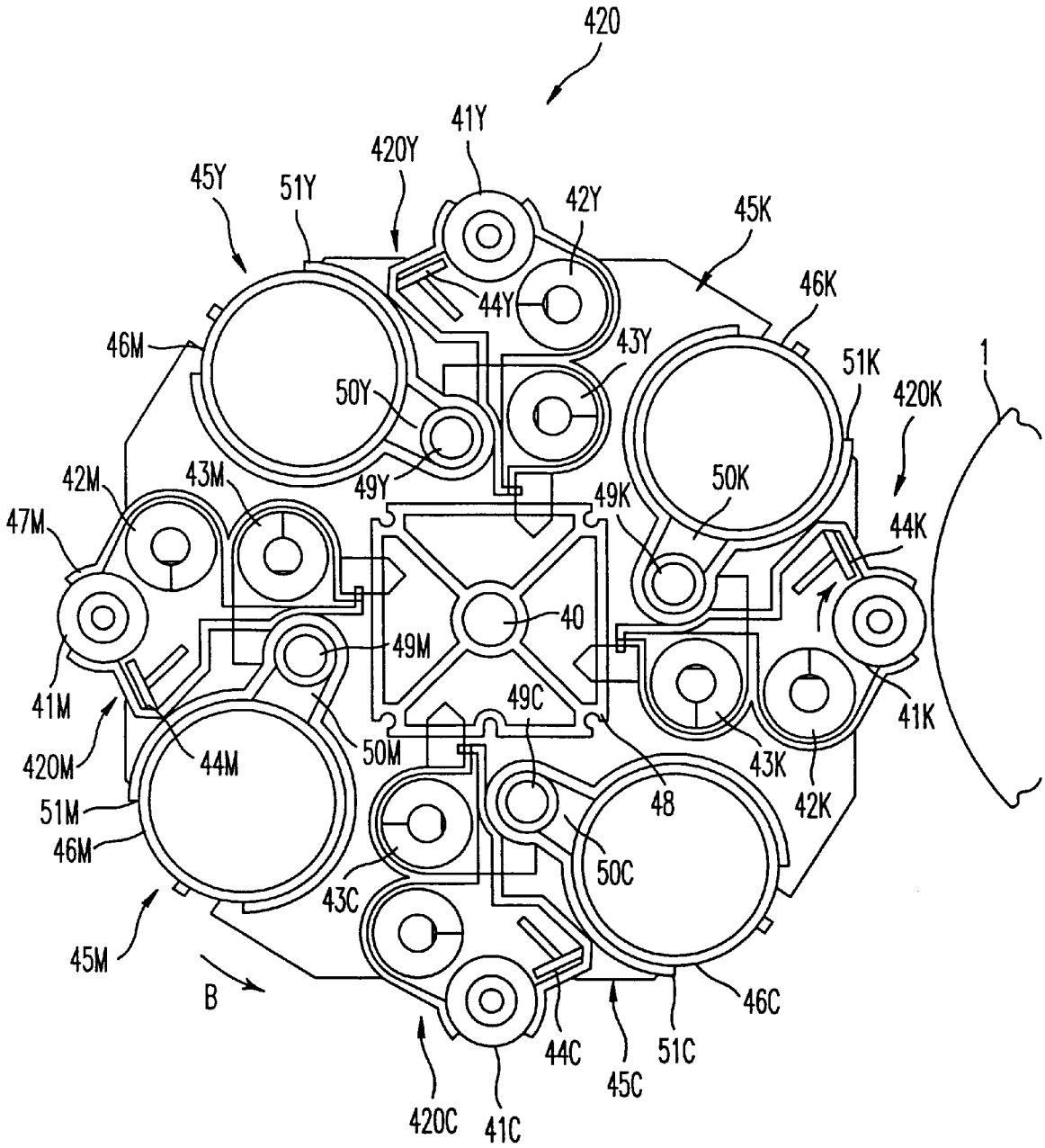
FIG. 2 is a schematic construction of a rotary image-developing station of the printer in FIG. 1.

The rotary image-developing station 420 is constructed with a supporting member 402 (see FIG. 3) that rotates around a rotation shaft 40 (see FIG. 2). The supporting member 402 supports the above-mentioned four image-developing devices 420K, 420Y, 420M, and 420C. Further, the rotary image-developing station 420 has four toner supplying devices 45K, 45Y, 45M, and 45C for supplying toner to the four image-developing devices.

As shown in FIG. 2, a black image-developing device 420K which contains black toner and carrier is positioned in front of the photoconductive drum 1. Next to the black image-developing device 420k, there are located, in a counterclockwise direction, a yellow image-developing device 420Y that contains yellow toner and carrier, a magenta image-developing device 420M that contains magenta toner and carrier, and a cyan image-developing device 420C that contains cyan toner and carrier.

Since the internal structures of the four image-developing devices 420K, 420Y, 420M, and 420C are substantially the same, a description on the black image-developing device 420K is provided as an example and the same description is applicable to the other image-developing devices as well. Accordingly, in FIG. 2, for example, the image-developing devices other than the black image-developing device 420K are illustrated only roughly and added with reference marks Y, M, and C with the same numerals as the black image-developing device.

The aforementioned black image-developing device 420K is provided with a developing roller 41K as a developer bearing member, a first agitating screw 42K, and a second agitating screw 43K for agitating a two-component developer (hereinafter referred to as a developer) composed of the black toner and carrier that are contained in the casing of the black image-developing device 420K. The rotary image-developing station 420 that has the above-mentioned construction develops the latent image on the photoconductive drum 1 by making each of the image-developing devices move to a developing position. The image-developing devices face the photoconductive drum 1 in order by rotation thereof in the direction B as shown in FIG. 2.

The toner in the developer in black image-developing device 420K is consumed in each developing operation. When a toner density sensor (not shown) detects that the black image-developing device 420K decreases the toner density, the toner is supplied to the image-developing device from the toner bottle 46K as a developer container of the toner supplying device 45K. Thereby, the toner density is kept at a predetermined level and the image density is kept constant. The rotary image-developing station 420 is supported on a developing unit supporting member (hereinafter referred to as unit supporting member 200) that is retractable from a main body of the printer 100. The unit supporting member 200 will be described referring to FIGS. 3 and 4.

Figure 3:
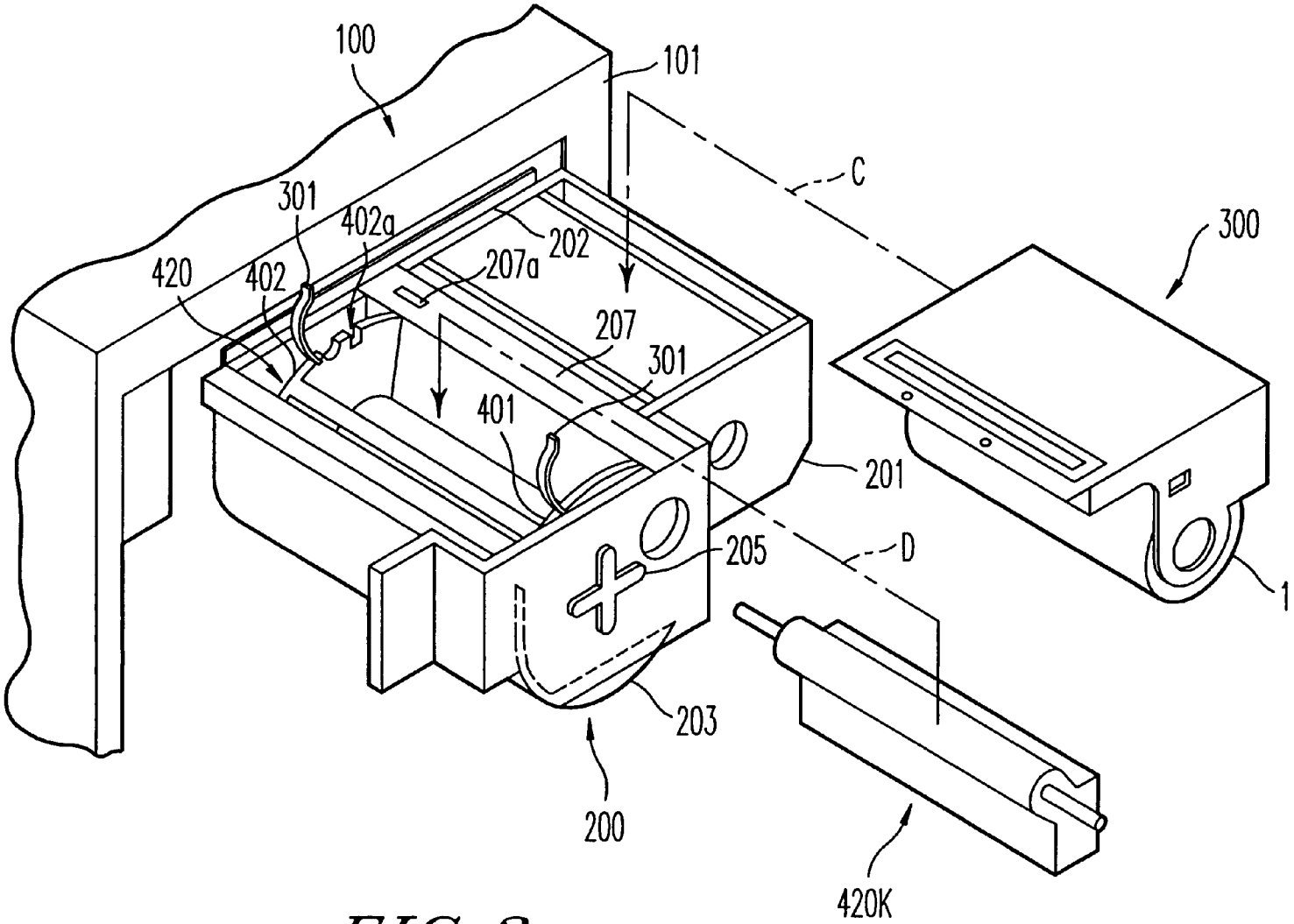
FIG. 3 is a perspective view of a unit supporting member of the printer in FIG. 1.
Figure 4:
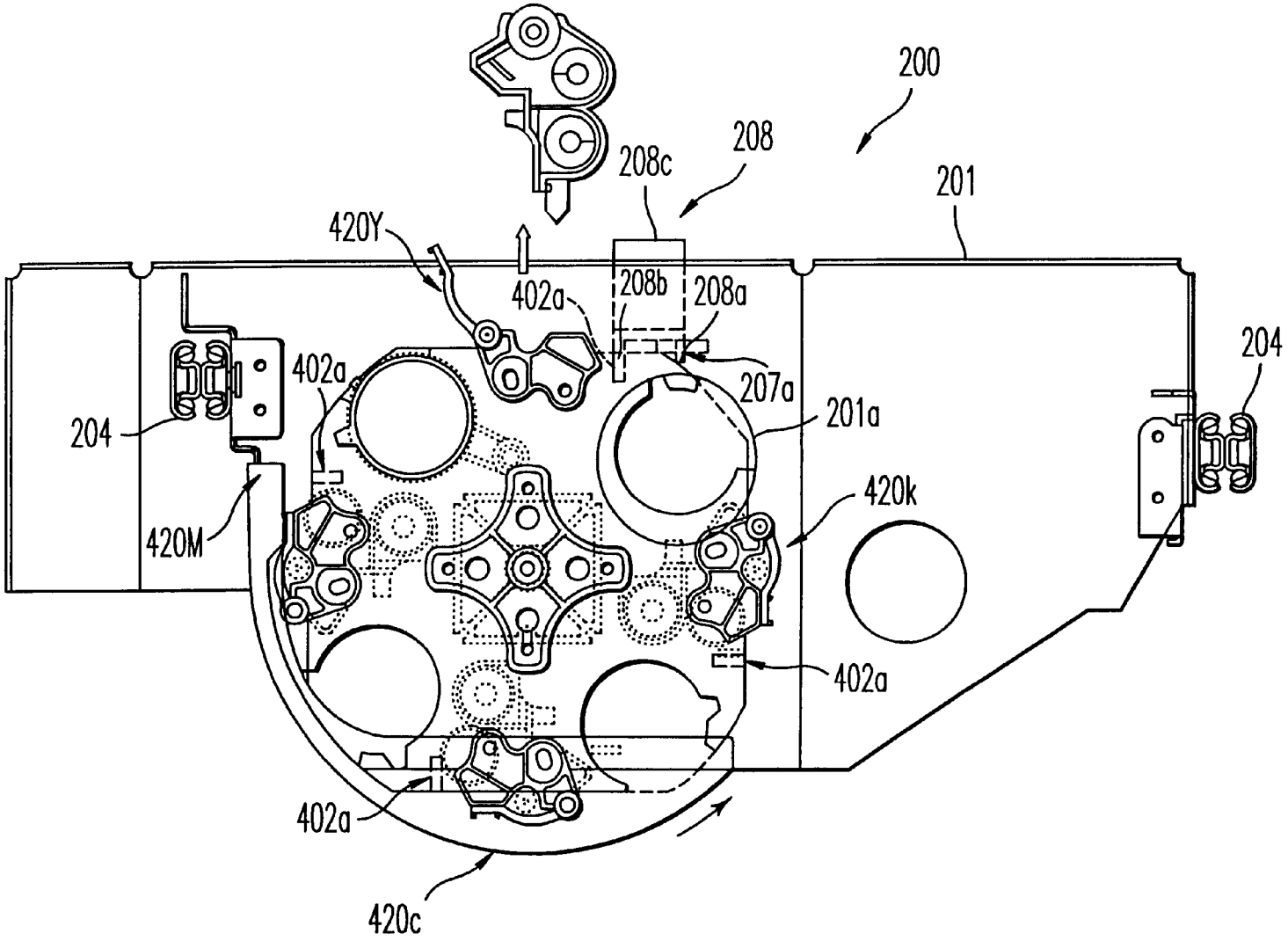
FIG. 4 is a front elevation of the unit supporting member in FIG. 3.

FIG. 4 is a front elevation of the unit supporting member 200 when the black image-developing device 420K is at the developing position. Further, the toner bottles other than the toner bottle 46K (see FIG. 2) that contains the toner to be supplied to the black image-developing device 420K are not shown. In an example shown in the FIG. 3, the unit supporting member 200 serves as a supporting member of a photoconductive element unit 300. In addition, the photoconductive element unit 300 is mounted on the unit supporting member 200 as indicated by arrow C in FIG. 3.

The unit supporting member 200 has stay members of a front side board 201, a rear side board 202, and four stay members as a total of right and left, top and bottom in a center part. In the unit supporting member 200, a toner receiver 203 that can be attached/detached with ease by flexing thereof is provided at a lower part of the supporting portion where the rotary image-developing station 420 is supported. The toner receiver 203 can thus be made attachable/detachable with ease by constructing the same with a flexible material such as PET (polyethylene terephthalate).

A sliding rail (a rail capable of sliding which is held for linear movement including a number of steel balls which is located on a straight line, while the balls in a ball bearing are located on a circular line) 204 is mounted on both side portions of the unit supporting member 200 (see FIG. 4). Thereby, the unit supporting member 200 can slide in advancing and retreating movements at a front side of the main body of the image forming apparatus. The aforementioned black image-developing device 420K is mounted on a supporting mechanism which is described later so that the black image-developing device 420K is detachable from the rotary image-developing station 420.

In a detailed description, the black image-developing device 420K is mounted on the rotary image-developing station 420 as indicated by arrow D in FIG. 3. In addition, in this unit supporting member 200, a construction for drawing the sliding rail in a stroke equal to or more than an entire length of the black image-developing device 420K is adopted. Thereby, the black image-developing device 420K can be exposed when unit supporting member 200 is drawn out to the front side in a state of supporting the rotary image-developing station 420. In further detail, two rows of sliding rails having a length of 500 mm each when the sliding rails are tucked, and a sliding stroke of 650 mm, can be adopted as the sliding rail 204.

Figure 6:
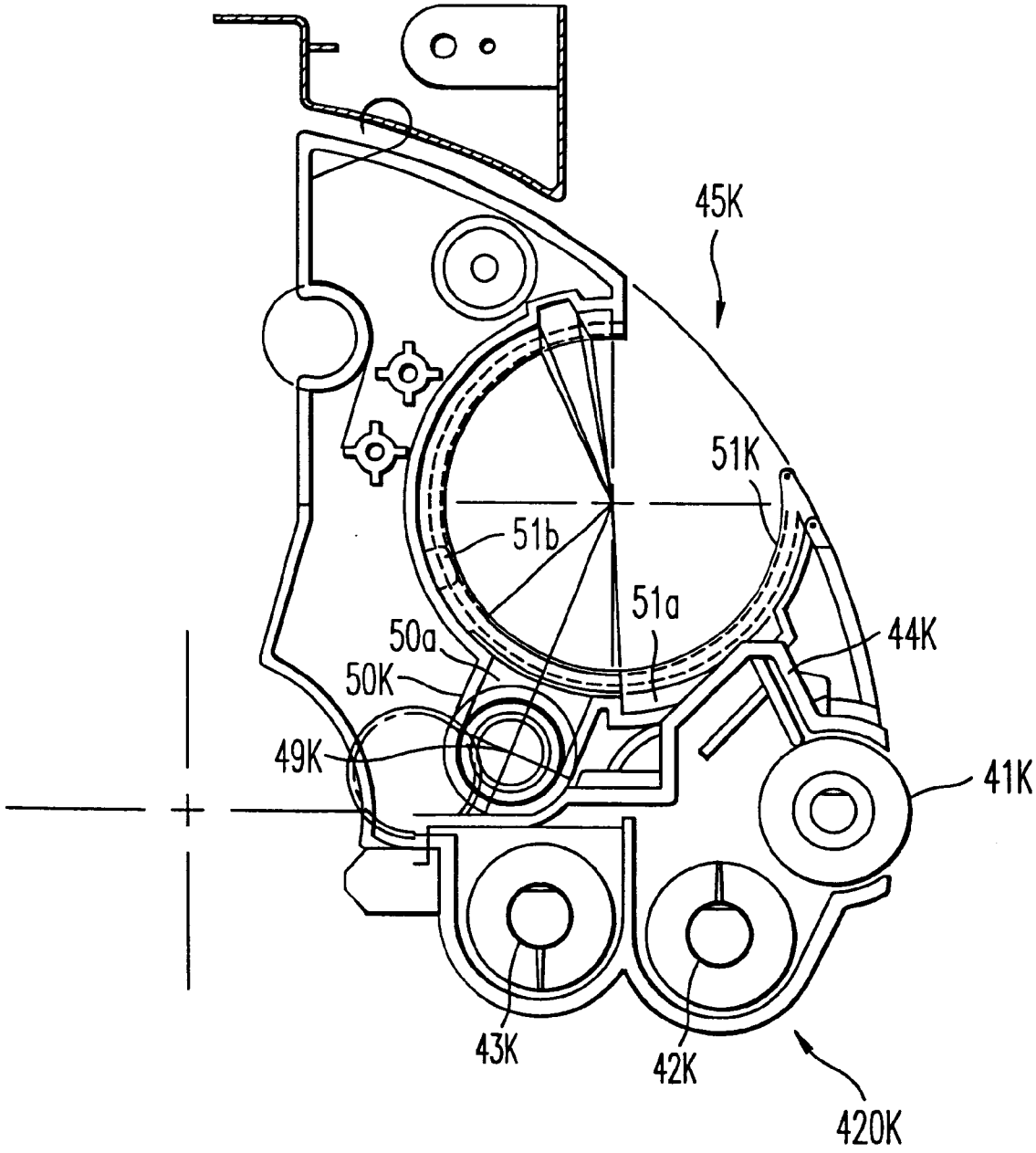
FIG. 6 illustrates a construction of a toner supplying device of the developing unit in FIG. 5.

Next, a structure of the toner supplying device of the developing unit is illustrated. A structure of the toner supplying devices 45C, 45M, 45Y, and 45K of each of the image-developing devices 420K, 420Y, 420M, and 420C is also similar to each other. Accordingly, only the construction of the toner supplying device 45K of the black image-developing device 420K is described referring to FIGS. 6 through 9. The toner supplying device 45K is constructed with a toner supplying screw 49K, a toner supplying case 50K as the developer supply amount controller, and a toner bottle guide 51K as shown in FIG. 6.

Figure 7A:
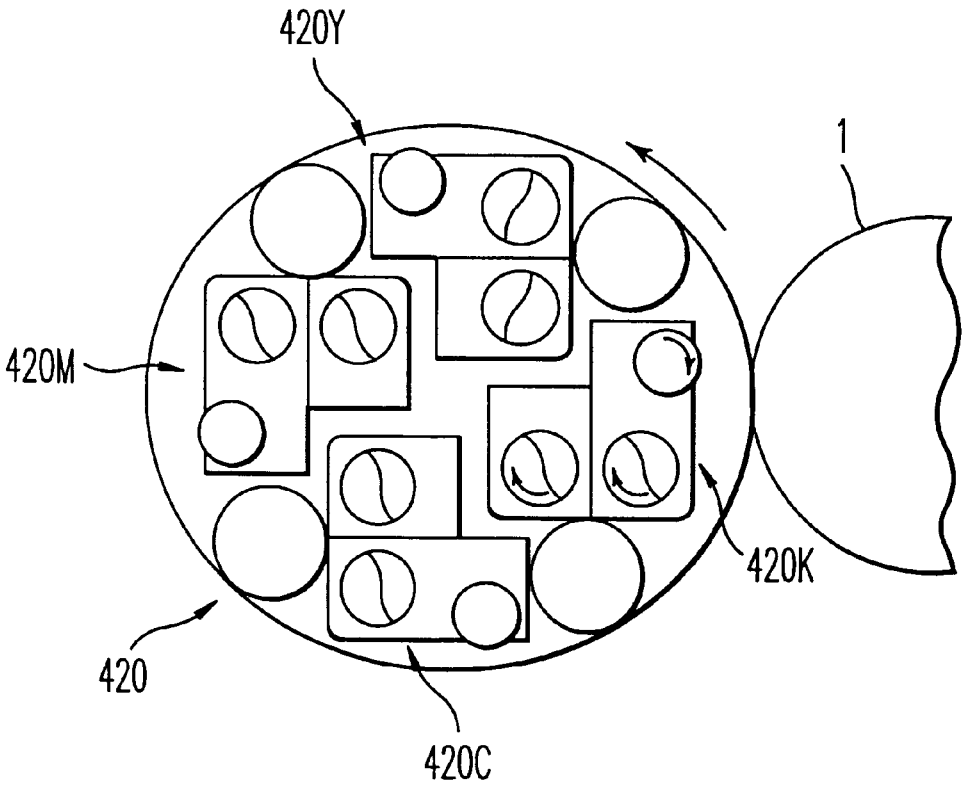
FIG. 7A is a schematic illustration of the rotary image-developing station illustrating a toner-flow by the toner supplying device in FIG. 6.
Figure 7B:
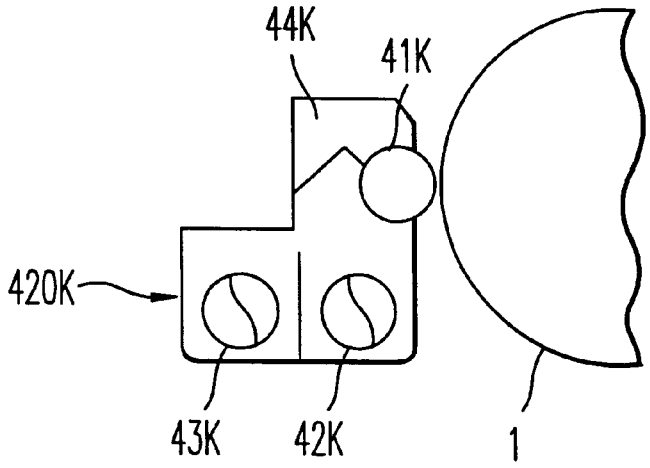
FIG. 7B is a schematic illustration of a developing unit illustrating the toner flow by the toner supplying device in FIG. 6.
Figure 8:
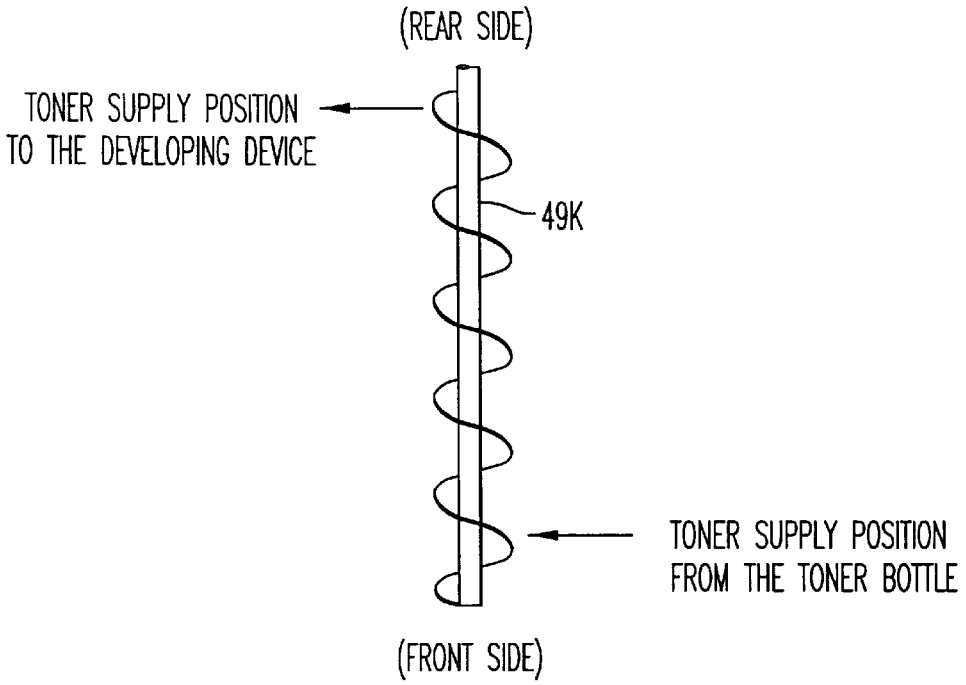
FIG. 8 is a schematic top plan view showing a main part of a toner supplying screw of the toner supplying device in FIG. 6.
Figure 9:
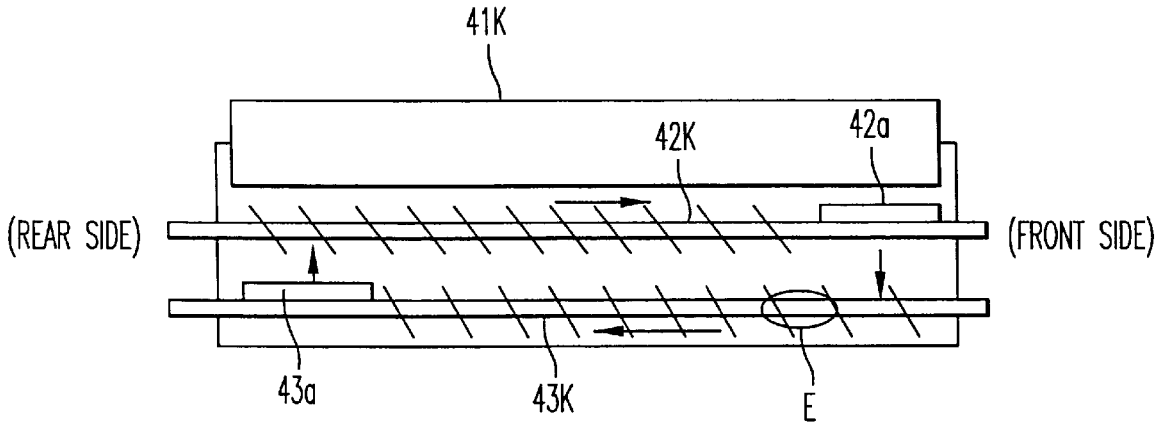
FIG. 9 is a schematic top plan view of the developing unit illustrating the toner flow by the toner supplying device in FIG. 6.

A manner of conveying toner to the toner supplying case 50K is described below. Each of the image-developing devices 420K, 420Y, 420M, and 420C is rotated in a direction indicated by the arrow shown in FIG. 7A. The black image-developing device 420K of the developing unit 420 that includes the toner supplying device 45K is stopped at the development position in front of the photoconductive drum 1 as shown in FIG. 7B. Then, the toner bottle 46K, which is described later, is inserted and set into a toner bottle guide 51K through an opening 201*a* (in FIG. 4) by an operator. The opening 201*a* is prepared for attaching/detaching the toner bottle and is opened on a front side board 201 of the unit supporting member 201. Thereby, a toner supplying outlet 71*b* of the toner bottle 46K (see FIG. 10) faces the toner inlet 50*a* (see FIG. 6) that is formed at a front side of the toner supplying case 50K.

Figure 10:
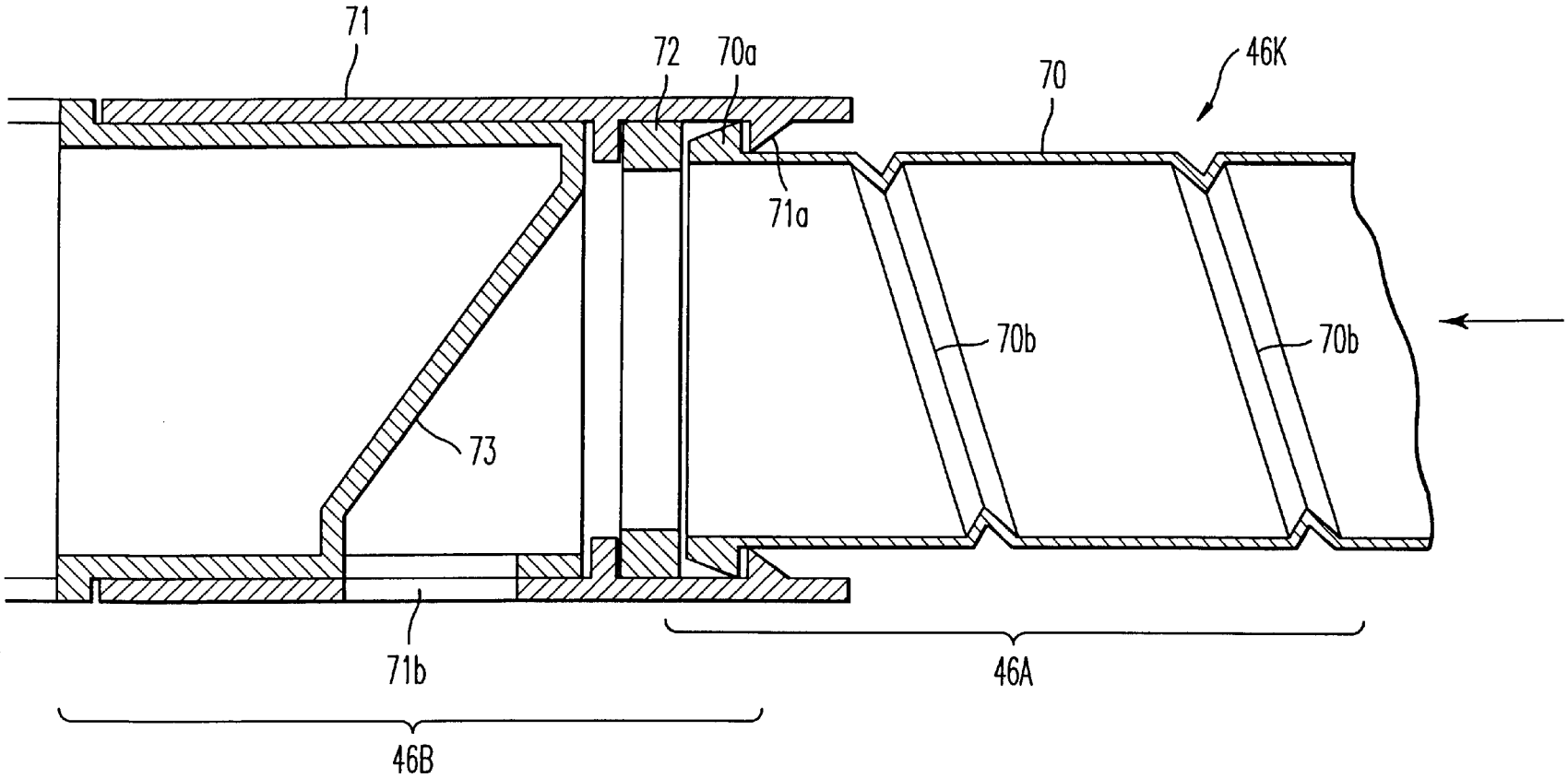
FIG. 10 is a main part enlarged cross-sectional view of a toner bottle attached to the toner supplying device in FIG. 6.

In this state, when the rotary image-developing station 420 is rotated around a rotation shaft 40 (see FIG. 2), the toner bottle 46K is rotated and the toner therein is conveyed into the toner supplying case 50K. On the other hand, the toner supplying screw 49K is rotated by a special screw driving motor (not shown) for supplying the toner. Thereby, the toner conveyed to the toner supplying case 50K is further conveyed to a toner supplying position E (see FIG. 9) which is directed to the black image-developing device 420K from the toner supplying position of the toner bottle 46K as shown in FIG. 10.

Figure 5:
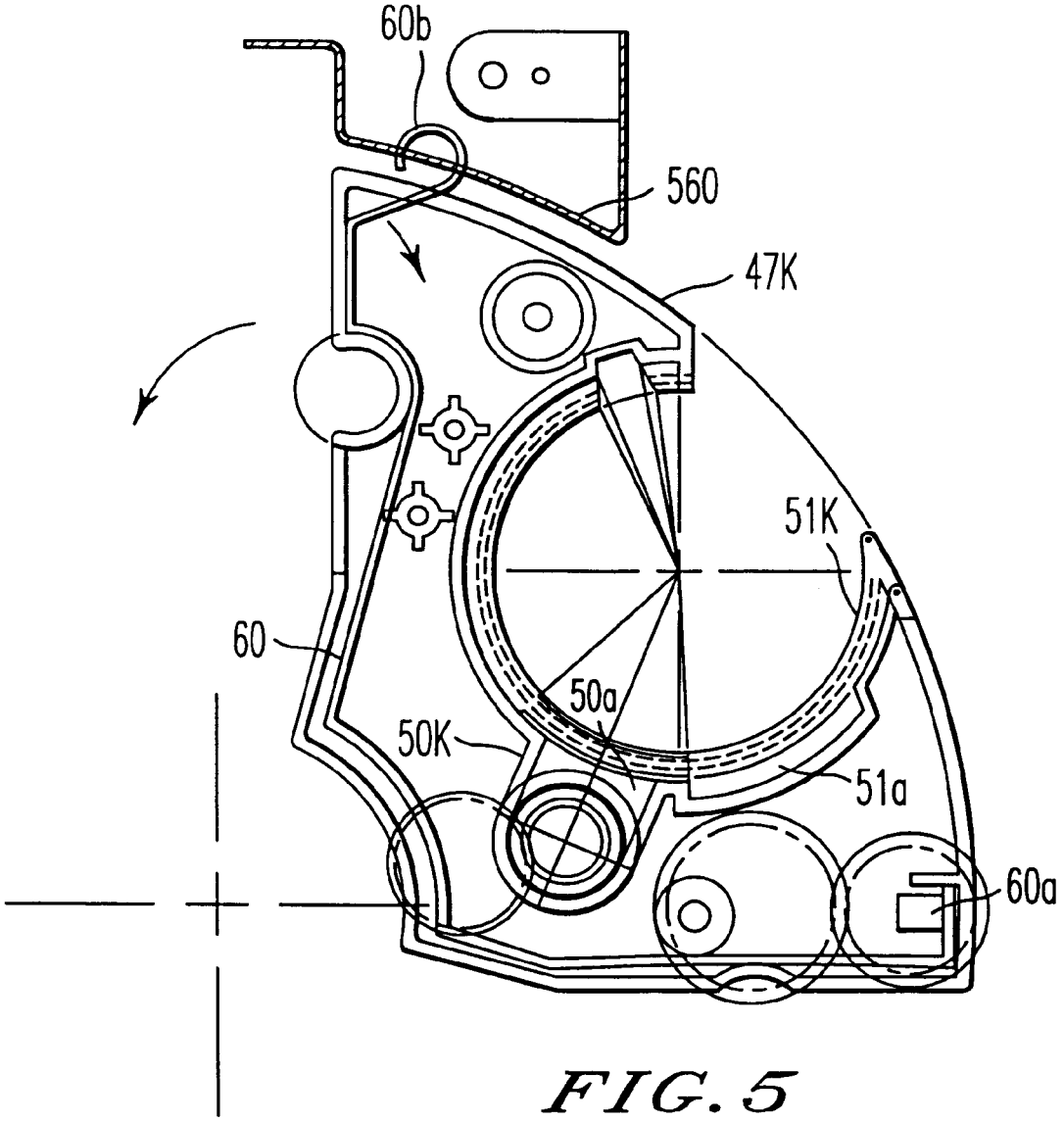
FIG. 5 illustrates a construction of a developing unit of the rotary image-developing station in FIG. 2.

According to the above described manner, the toner is gradually supplied to a position at a front side of the second agitating screw 43K in a developing casing 47K of the black image-developing device 420K. Thus, the toner is supplied to the black image-developing device 420K from the toner bottle 46K by the toner supplying device 45K. The toner which is supplied to the toner supplying position E at the front side of the second agitating screw 43K of the black image-developing device 420K is conveyed to the rear side of the developing casing 47K (see FIG. 5) being agitated by a rotation of the second agitating screw 43K shown in FIG. 9 and is scattered in the developer in the developing casing 47K. The rotation of the second agitating screw is started by a signal for supplying the toner generated by a process control.

Further, any toner which is scattered into the developer, and which is conveyed to the rear side of the developing casing 47K, is transferred to the side of the first agitating screw 42K at a rear end of the developing casing 47K. In addition, the toner is conveyed to a front side of the developing casing 47K as it is agitated by a rotation of the first agitating screw 42K. Thereafter, the toner is again transferred to the side of the second agitating screw 43K at the front end of the developing casing 47K. The transferring of the toner mixed in the developer is performed by a rotation of the fins 42*a* and 43*a* mounted on one end side of each of the agitating screws (see FIG. 9).

As described above, a part of the developer that is circulated in the developing casing 47K is scooped up by a developing roller 41K and conveyed in a conveying process of the developer. The developer scooped up by the developing roller 41K is conveyed to the developing area after being thinly layered by a developing doctor blade 44K. The developer is used for developing the latent image on the photoconductive drum 1 to a toner image at the developing area.

Figure 11:
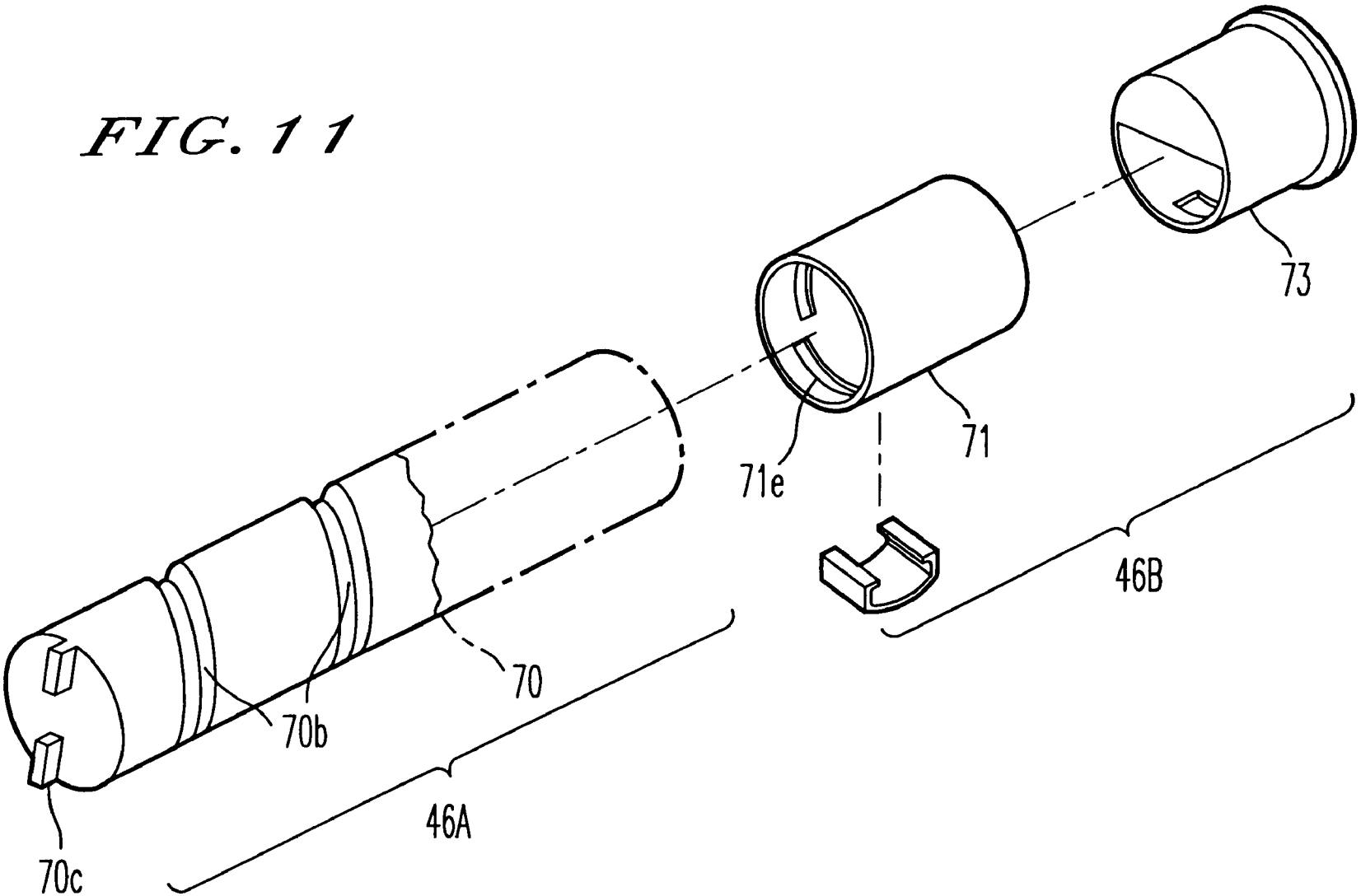
FIG. 11 is an exploded perspective view showing a schematic construction of the toner bottle in FIG. 10.

Next, a construction of the toner bottle used in the printer is described. Each of the toner bottles 46C, 46M, 46Y, and 46K has an identical structure and each of the toner supplying devices also has an identical structure as well, and accordingly, only the toner bottle 46K in the toner supplying device 45K of the black image-developing device 420K is described hereinafter referring to FIGS. 10 through 13. This toner bottle 46K is, as shown in FIGS. 10 and 11, composed of a rotating portion 46A including a screw bottle 70 where the toner to be supplied is contained, a fixed portion 46B composed of an outside cap 71, a sealing member 72, and an inside cap 73.

The screw bottle 70 which is a rotating portion 46A of the toner bottle 46K is hooked with the outside cap 71 of the fixed portion 46B in a rotatable manner as shown in FIG. 10. The ring-like shaped convex portion 70*a*, which is mounted on the end of the screw bottle 70 at a side where the toner flows out, is hooked to a convex portion 71*a* mounted on an inner wall of the outside cap 71 of the aforementioned fixed portion 46B. Thus, the screw bottle 70 can rotatably be connected to the outside cap 71 without a complicated structure of the toner bottle 46K and without increasing the manufacturing costs thereof by hooking the fixed portion 46B with the rotating portion 46A.

Further, the toner is prevented from leaking out from a connecting portion of the fixed portion 46B of the toner bottle 46K and the rotating portion 46A. This is because the end face of the screw bottle 70 at a side where the toner flows out lightly closely contacts the side face of the sealing member 72. This is also because the fixed portion 46B of the toner bottle is hooked with the rotating portion 46A of the toner bottle 46K, as shown in FIG. 10. Furthermore, a toner supplying outlet 71*b* is mounted on the outside cap 71 at the fixed portion 46B of the toner bottle 46K. This outlet 71*b* is an opening for the toner to flow out to the toner inlet 50*a* of the toner supplying case 50K shown in FIG. 6.

Figure 12A:
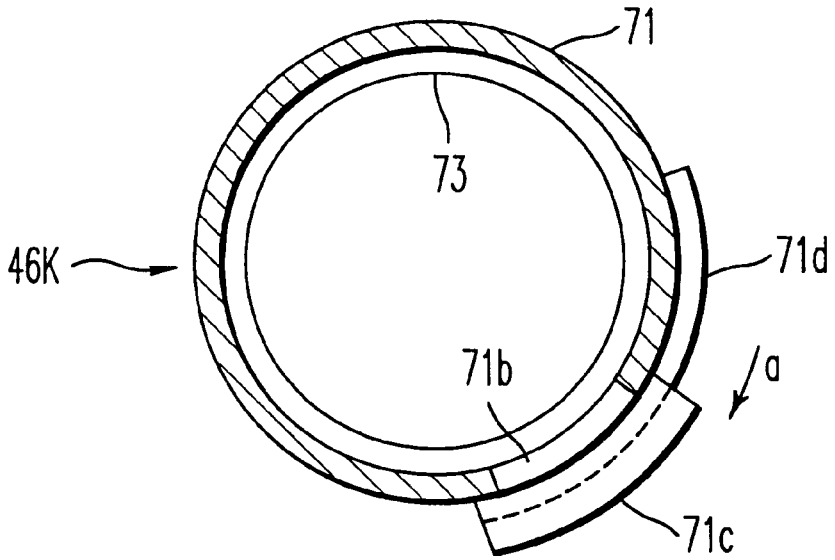
FIGS. 12A and 12B are main part enlarged cross-sectional views illustrating a process of attaching the toner bottle to the toner supplying device.
Figure 12B:
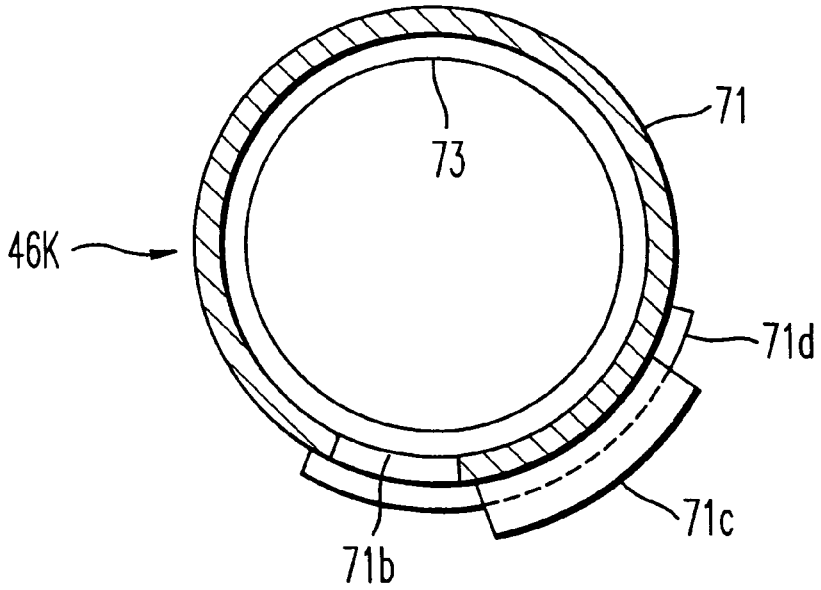

As shown in FIG. 12A, a shutter 71*c* opens and closes the toner supplying outlet 71*b*, and a shutter guide rail 71*d* guides the shutter 71*c* along the circumferential direction of the outer wall of the outside cap 71 and is mounted on the outside cap 71. This outside cap 71 is rotated in a direction indicated by arrow "a" in a state of being normally inserted into the toner bottle guide 51K shown in FIG. 6. Thereby, the shutter 71*c* of the outside cap 71 relatively moves along the shutter guide rail 71*d,* and the toner supplying outlet 71*b* faces the toner inlet 50*a* of the toner supplying case 50K as shown in FIG. 12B.

Namely, this toner bottle 46K is inserted and set in the toner bottle guide 51 through the opening 201*a* which is formed at the front side board 201 of the unit supporting member 200 for attaching/detaching the toner bottle 46K, as described above. The toner bottle 46K is inserted in a state that the black image-developing device 420K of the developing unit, which has the toner supplying device 45K, is stopped adjacent to the developing position. At this moment, the toner supplying device 45K faces the photoconductive drum 1.

Thereby, the shutter 71*c* mounted on the outside cap 71, which is the fixed portion 46B of the toner bottle 46K, is fit into a shutter fitting concave 5l*a* (see FIG. 5) formed on an inside portion of the toner bottle guide 51K. In this state, the fixed portion 46B of the toner bottle 46K is rotated to a position, shown in FIG. 12B, in a direction indicated by arrow "a". Then, the shutter guide rail 71*d* moves relative to the shutter 71*c* being kept fixed to a shutter fitting concave 51*a* and contacts a stopper 51*b* (see FIG. 6). Thereby, the toner supplying outlet 71*b* is opened and faces the toner inlet 50*a* of the toner supplying case 50K.

When the toner bottle 46K is detached from the toner supplying device 45K, a reverse operation of the setting operation as mentioned above is performed, namely, the toner bottle 46K is rotated in a direction reverse to that indicated by arrow "a" in FIG. 12A. Thereby, the toner supplying outlet 71*b* of the outside cap 71 is closed with the shutter 71*c*. Thereafter, the toner bottle 46K is pulled out from the inside of the toner bottle guide 51K. In addition, a stopper (not shown) can be mounted on the toner bottle 46K so that the toner bottle 46K cannot be inserted or pulled out from the toner bottle guide 51K except at a state that the toner supplying outlet 71*b* of the outside cap 71 is completely shut with the shutter 71*c*.

A spiral projection 70*b* as a toner guiding member for conveying the toner, which is contained in the screw bottle 70, to the toner supplying outlet 71*b* of the fixed portion 46B is formed at an inner wall of the screw bottle 70, which is a rotating portion 46A of the toner bottle 46K, as shown in FIGS. 10 and 11. Further, a projection 70*c* for engaging with coupling 81 shown in FIG. 13 is mounted on a bottom of the screw bottle 70.

Figure 13:
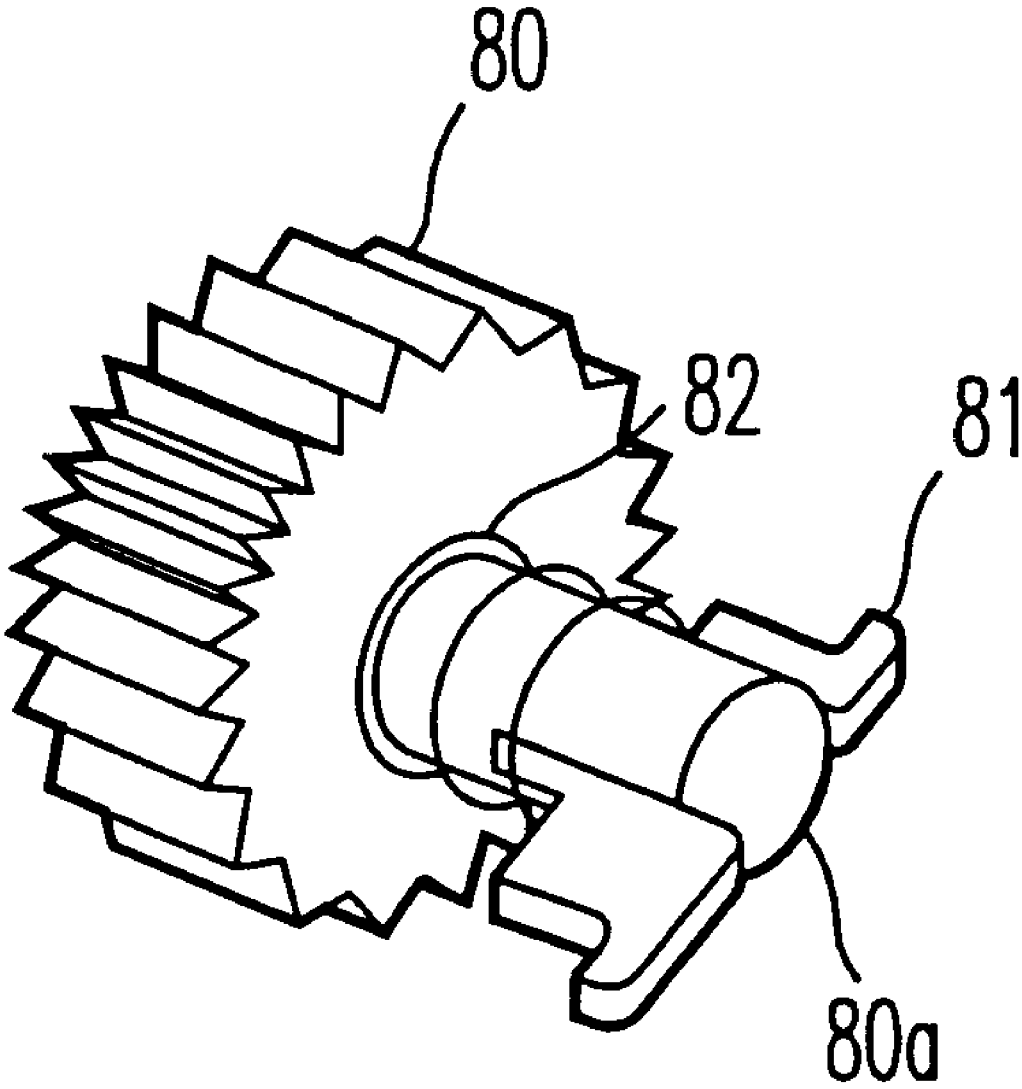
FIG. 13 is a schematic perspective view showing a construction of a coupling for rotating a screw bottle which is a rotational part of the toner bottle attached to the toner supplying device.

As shown in FIG. 13, the coupling 81 is disposed for each toner bottle at a predetermined portion of the rotary image-developing station 420. Thereby, the toner bottle 46K (46Y, 46M, and 46C) is connected in a coupling connection to the projection 70*c* formed at the bottom of the screw bottle 70 for engaging with the coupling 81. The toner bottle 46K is connected to the projection 70*c* in a state of being inserted and set in the toner bottle guide 51K, through the opening 201*a* for attaching/detaching the toner bottle, which is opened at the front side board 201 of the unit supporting member 200, as described above.

This coupling 81 is rotatably mounted on a supporting shaft 80*a* of a coupling gear 80 that is driven by a drive gear (not shown) provided at a side of the main body of the printer, through a coil spring 82, slidably along the longitudinal direction of the supporting shaft 80*a*. Hereupon, the aforementioned coupling gear 80 is constructed so that the coupling gear 80 is engaged with the aforementioned drive gear provided at the side of a main body of the printer when the rotary image-developing station 420 is rotated and stopped at a predetermined developing position which any one of the image-developing devices faces.

Thus, an attaching/detaching operation of the toner bottles 46K, 46Y, 46M, and 46C to the toner supplying devices 45K, 45Y, 45M, and 45C is easily performed by mounting the projection 70*c* for engaging with the coupling 81, as a device for rotating the screw bottle 70, at a bottom portion of the screw bottles 70 of the toner bottles 46K, 46Y, 46M, and 46C.

On the other hand, in a usual copying operation, when the rotary image-developing station shown in FIG. 2 rotates, the toner bottle 46K is rotated around the rotation shaft of the rotary image-developing station 420. By this rotation movement, the toner in the screw bottle 70 is conveyed to the toner supplying outlet 71*b* of the fixed portion 46B of the toner bottle 46K along an inner wall of the screw bottle 70 by the spiral projection 70*b* formed on the inner wall of the screw bottle 70 of the rotating portion 46A of the toner bottle 46K.

However, when an extensive number of copies are produced from one original document at a time, an amount of toner consumption of the developer in the corresponding image-developing device may exceed an amount of toner supplied by a rotation of the toner bottle 46K. Accordingly, the toner density of the developer in the image-developing device may significantly decrease.

In such a case in the background image forming apparatus, the copying operation is stopped for a time to perform a toner supplying operation for rotating the toner bottle 46K by rotating the rotary image-developing station 420. Thereby, a waiting time is required during the copying operation. In addition, a toner conveying property of the toner supplying operation by the rotation of the toner bottle 46K is not sufficient, and it takes a relatively long time for supplying the toner. Further, the developer conveying ability of the toner bottle 46K deteriorates.

In contrast, in the printer relevant to the present invention, the coupling gear 80 shown in FIG. 13 is driven when the toner density detecting device (not shown) is operated. In other words, the coupling gear 80 is driven when the toner consumption of the developer of the corresponding image-developing device exceeds the toner supplying amount by the rotation of the toner bottle 46K, and therefore the toner density of the developer in the corresponding image-developing device is significantly decreased.

Thereby, the screw bottle 70 of the rotating portion 46A of the toner bottle 46K is independently rotated via the projection 70*c* which is engaged with the coupling 81 of the coupling gear 80, being kept at a state that the corresponding image-developing device of the rotary image-developing station 420 is facing the predetermined developing position.

In the printer relevant to the present invention, the copying operation is not required to be stopped for a period of time, even though the toner density of the developer in the image-developing device is significantly decreased due to producing an extensive number of copies from one original document at a time, namely, if the amount of the toner consumption of the developer in the corresponding image-developing device exceeds the toner supplying amount by the rotation of the toner bottle 46K.

Further, in the printer relevant to the embodiment of the present invention, since the toner is not supplied by the rotation of the toner bottle 46K but is supplied by directly rotating the screw bottle 70, a conveying property of the toner in the screw bottle 70 is remarkably improved and a required time for a toner supplying operation is shortened. Furthermore, by thus supplying the toner utilizing the rotation of the screw bottle 70 of the toner bottle 46K around its own axis, the rotation of the same around the center of the rotary image-developing station 420, and the spiral projection 70*b*, an inexpensive toner bottle that does not require a stirring member to be contained with the toner therein can be provided.

The spiral projection 70*b* can also be manufactured without performing any special process, since the spiral projection 70*b* can be constructed in a body with the screw bottle of the toner bottle 70. Thereby, a further inexpensive toner bottle with a low manufacturing cost can be provided. In addition, in the printer relevant to the present invention, the toner bottle 46K has a construction divided into two parts such as a fixed portion 46B which is hooked/fixed to the toner supplying case 50K, and a rotating portion 46A that is rotatably hooked to the fixed portion 46B and is driven by the coupling gear 80 as described above.

Hereupon, a rotating direction of the screw bottle 70 of the rotating portion 46A of the toner bottle 46K is predetermined to be the same direction as that of the outside cap 71 when the outside cap 71 of the fixed portion 46B of the toner bottle 46K is hooked and fixed to the toner supplying case. Thereby, the hooking/fixing portion of the outside cap 71 to the toner supplying case 50K is prevented from being displaced due to a rotating of the outside cap 71 together with the screw bottle 70 while rotating, resulting in a deviation of the positional relation between the toner inlet 50*a* of the toner supplying case 50K and the toner supplying outlet 71*b* of the outside cap 71. In addition, the outside cap 71 is prevented from being dropped off from the hooking/fixing portion of the toner supplying case 50K.

On the other hand, in the toner bottle 46K (46Y, 46M, and 46C) which has the aforementioned construction, there is no problem if a sufficient amount of the toner is contained. However, if the amount of the toner is decreased, there is a problem that the toner flow at the side of the opening (the side of the fixed portion 46B) deteriorates. Therefore, the supplying operation of the toner to the image-developing device is not smoothly performed.

Figure 14:
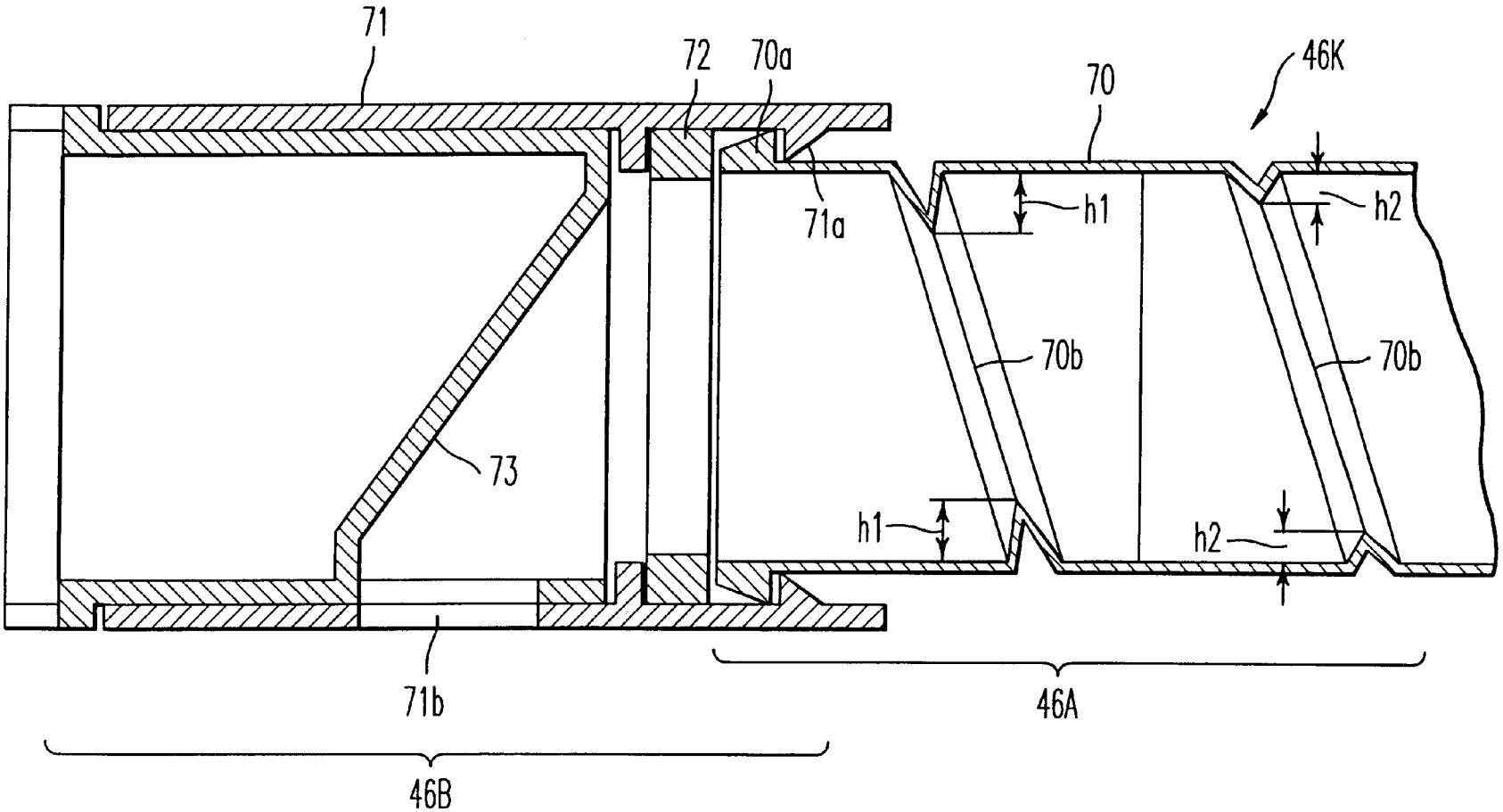
FIG. 14 is a schematic cross-sectional view showing another embodiment of a toner bottle.

Accordingly, in this toner bottle 46K (46Y, 46M, and 46C) it is preferable that heights h1 and h2 of the spiral projection 70*b* mounted on the inner wall are formed to make the height h1 higher than the height h2 when h1 is closer to the side of the opening of the toner bottle 46K than h2, as shown in FIG. 14.

Thus, by forming the height h1 of the spiral projection 70*b* at a side of the opening, which is mounted on the inner wall of the toner bottle, higher than that of another spiral projection h2, the toner conveying ability at a position adjacent to the opening portion of the toner bottle is improved. In addition, the toner flow at the position adjacent to the opening portion of the toner bottle can be made smooth.

The toner bottles 46K, 46Y, 46M, and 46C are disposed at the toner supplying devices 45K, 45Y, 45M, and 45C respectively, so that the inner walls of the toner bottles in a longitudinal direction are approximately parallel to the rotation shaft 40 of the aforementioned rotary image-developing station 420. Thereby, the toner in the toner bottle 46K (46Y, 46M, and 46C) is displaced along the inner wall thereof by rotation of the toner bottle 46K (46Y, 46M, and 46C) resulting from rotation of the rotary image-developing station 420. Consequently, the toner is effectively conveyed to the side of the opening by the spiral projection 70*b* mounted on the inner wall.

Further, in the toner bottles 46K, 46Y, 46M, and 46C, a spiral projection 71*e* as a guide for conveying the toner to the toner supplying outlet 71*b* is mounted at the inside wall of the outside cap 71 of the fixed portion 46B, as shown in FIG. 11. In these toner bottles 46K, 46Y, 46M and 46Y, the toner in the fixed portion 46B that is not conveyed by the rotation of rotating portion 46A is effectively conveyed by an action of the aforementioned spiral projection 71*e* resulting from rotation of the toner bottles 46K, 46Y, 46M, and 46C on the basis of the rotation of the rotary image-developing station 420.

As for a toner-end state detection of the image forming apparatus, a P sensor type detecting device for detecting adhered toner on a photoconductive element is well known. However, since a P sensor type detecting device detects the toner-end state when the toner adhered on the photoconductive element is decreased, the toner density of the developer in the image-developing device is already decreased when the toner-end state is detected.

Accordingly, in the image forming apparatus that performs the toner-end state detection with this P sensor type detection, there is a problem that, in particular, a color tone of the copied image is different from a usual one at a time when a full color image is copied under a condition of getting close to the toner-end state at a certain color. Therefore, in the image forming apparatus relevant to the present invention, a toner-end sensor 500 as a remaining toner amount detecting device for detecting the remaining toner amount in the toner bottle is provided at a position adjacent to the opening of the toner bottles 46K, 46Y, 46M, and 46Y, as shown in FIGS. 15 and 16.

Thus, in the image forming apparatus that is provided with the toner-end sensor 500 adjacent to the opening of the toner bottles 46K, 46Y, 46M, and 46C, even in a case when the remaining toner amount in the toner bottle is detected to be the toner-end state by the toner-end sensor 500, the toner density of the developer of each of the image-developing devices 420K, 420Y, 420M, and 420C is kept at an appropriate value. Accordingly, in this image forming apparatus, there is no possibility that the color tone of the copied image is made different from a usual one, even when the toner of the developer of a certain color becomes close to the toner-end state when the full color image copy is produced.

Figure 15:
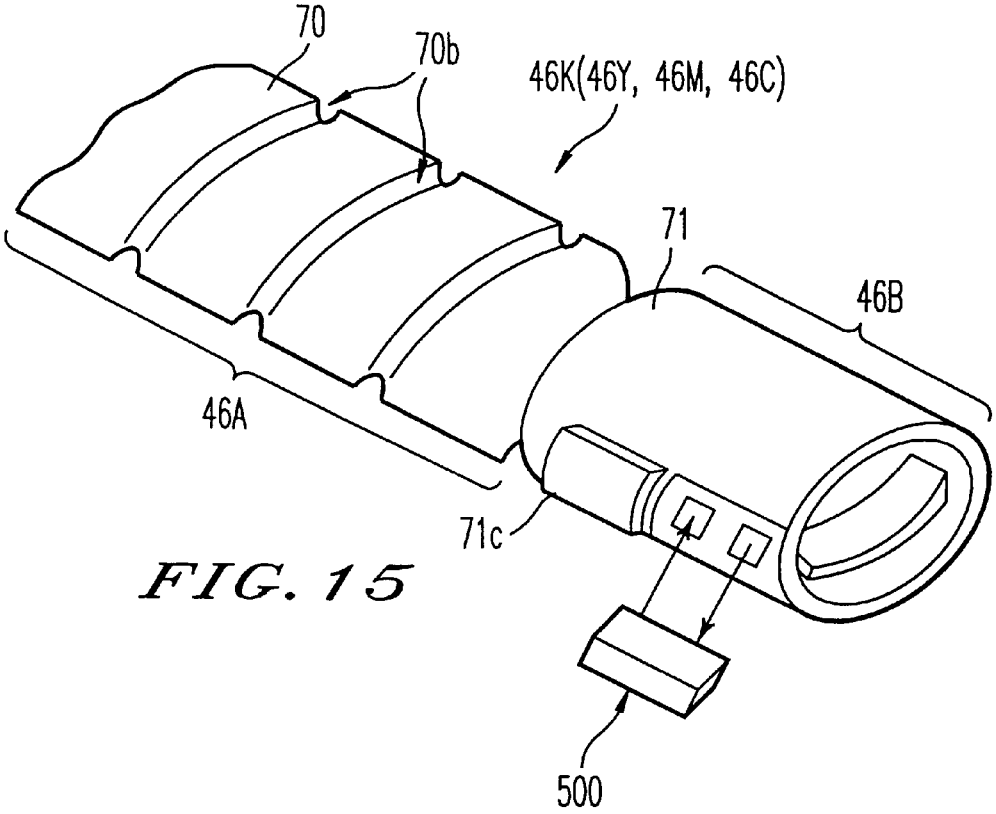
FIG. 15 is a schematic perspective view showing the toner bottle having a remaining amount of developer detecting device.
Figure 16:
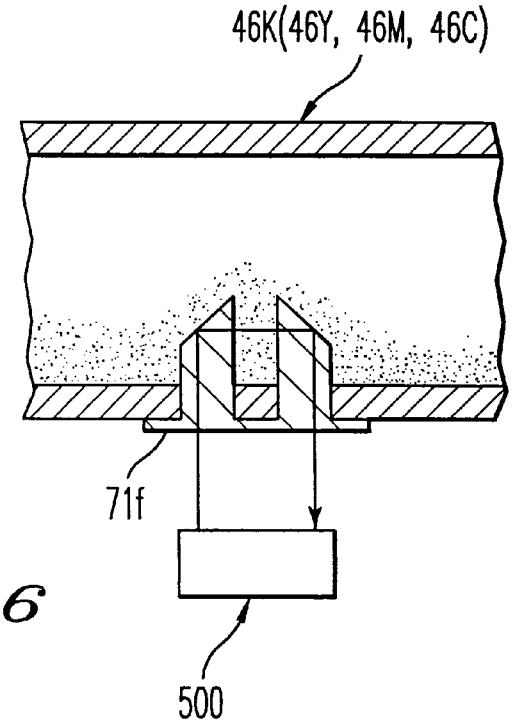
FIG. 16 is a schematic cross-sectional view showing a construction of a main part of the toner bottle having the remaining amount of developer detecting device.

The toner-end sensor 500 detects a remaining amount of the toner in the toner bottle by optically detecting a transmissivity of the toner using a photodiode and a phototransistor through a detecting window 71*f* formed at a position adjacent to the opening of the fixed portion 46B of the toner bottle 46K (46Y, 46M, and 46C), as shown in FIGS. 15 and 16. Thus, the detecting window 71*f* is mounted at a position adjacent to the opening of the fixed portion 46B of the toner bottle 46 (46Y, 46M, and 46C), for optically detecting the remaining amount of the toner by the toner-end sensor 500. Accordingly, an additional toner path for toner-end detection is not required. Thereby, the space for disposing the toner-end sensor 500 can be saved.

Having now fully described the present invention, it will be apparent to one of ordinary skill in the art that many changes and modifications can be made thereto without departing from the spirit and scope of the invention as set forth herein.

This application is based on Japanese patent application JPAP09-287976 filed on Oct. 3, 1997, Japanese patent application JPAP10-044701 filed on Feb. 9, 1998, and Japanese patent application JPAP10-237544 filed on Aug. 24, 1998, the entire contents of all of which are hereby incorporated by reference.

What is claimed is:

1. A developer container for use in a rotary image developing station in an image forming apparatus, comprising:

a fixed portion fixed on a developer supplying device of said rotary image developing station in said image forming apparatus; and a rotating portion rotatably supported by said fixed portion and including a guide;

wherein an opening is provided in the fixed portion, and the guide is arranged such that toner in the container is conveyed to the opening when the rotating portion is rotated relative to the fixed portion.

2. The developer container according to claim 1, wherein said guide is a spiral projection mounted on an inner wall of said developer container.

3. The developer container according to claim 2, wherein a height of said spiral projection mounted on said inner wall is higher at a side of said opening of said developer container than at another side of said developer container.

4. The developer container according to claim 2, wherein said developer container is provided with a guide mounted on said inner wall of said fixed portion for conveying said developer to said opening.

5. The developer container according to claim 1, wherein said rotating portion is rotatably hooked with said fixed portion by hooking with a first ring portion mounted on a wall of one side of one of said fixed portion and said rotating portion of said developer container with a second ring portion mounted on said wall of another side.

6. The developer container according to claim 1, further comprising developer detecting means for detecting a remaining amount of said developer and provided at a position adjacent to said opening of said developer container.

7. A developer container for use in a rotary image developing station in an image forming apparatus, comprising:

a fixed portion fixed on a developer supplying device of said rotary image developing station in said image forming apparatus; and a rotating portion rotatably supported by said fixed portion and including means for guiding toner;

wherein an opening is provided in the fixed portion, and the means for guiding toner is arranged such that toner in the container is conveyed to the opening when the rotating portion is rotated relative to the fixed portion.

* * * * *

UNITED STATES PATENT AND TRADEMARK OFFICE

CERTIFICATE OF CORRECTION

PATENT NO. : 6,336,020 B1
DATED : January 1, 2002
INVENTOR(S) : Ishikawa et al.

It is certified that error appears in the above-identified patent and that said Letters Patent is hereby corrected as shown below:

Title page,
Item [54] and column 1, the title should read
-- [54] A DEVELOPER CONTAINER FOR USE IN AN IMAGE FORMING APPARATUS HAVING AN IMPROVED DEVELOPER-SUPPLYING MECHANISM --

Signed and Sealed this

Twenty-third Day of April, 2002

*Attest:*

*Attesting Officer*

JAMES E. ROGAN
*Director of the United States Patent and Trademark Office*